US006378479B1

(12) United States Patent
Nishidate et al.

(10) Patent No.: US 6,378,479 B1
(45) Date of Patent: Apr. 30, 2002

(54) STARTING SYSTEM FOR INTERNAL COMBUSTION ENGINE

(75) Inventors: Keisuke Nishidate; Koki Ueta; Shigeru Yumiyama, all of Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 52 days.

(21) Appl. No.: 09/645,490

(22) Filed: Aug. 25, 2000

(30) Foreign Application Priority Data

Aug. 27, 1999 (JP) ..... 11-240716

(51) Int. Cl.[7] ..... F02N 17/00
(52) U.S. Cl. ..... 123/179.25; 123/179.24
(58) Field of Search ..... 123/179.24, 179.28, 123/179.26, 179.25; 74/7 A, 7 C

(56) References Cited

U.S. PATENT DOCUMENTS 4,495,905 A * 1/1985 Morishita ..... 123/179 F

FOREIGN PATENT DOCUMENTS

JP 9-53550 2/1997

* cited by examiner

*Primary Examiner*—Bibhu Mohanty
(74) *Attorney, Agent, or Firm*—Crowell & Moring LLP

(57) ABSTRACT

In a starter, durability of a pinion and a ring gear is to be improved by eliminating such as a collision by bringing them in mesh with each other.

A rotatable intermediate shaft (for example, an input shaft of a generator) is interposed between an output shaft of a starter motor and a crankshaft, a ring gear is mounted on this intermediate shaft via a bearing, the ring gear and a pinion are normally brought in mesh with each other. A movable clutch element for coupling and releasing of the coupling between the intermediate shaft and the ring gear is fitted by a spline to the intermediate shaft, and a stationary clutch element is provided on the ring gear. When a starting switch 1 is turned ON, the clutch element is moved on a side of the ring gear by means of a lever and when the starting switch is turned OFF, the clutch element is separated from the ring gear. The intermediate shaft and the crankshaft are coupled with each other via pulleys and a belt.

7 Claims, 10 Drawing Sheets

STARTING SYSTEM FOR INTERNAL COMBUSTION ENGINE

BACKGROUND OF THE INVENTION

FIELD OF THE INVENTION

The present invention relates to a starting system (a starter) for an internal combustion engine.

In a conventionally well known starting system for an internal combustion engine, a pinion is mounted on a rotary shaft (an output shaft) of a starting motor via a one-way clutch and a helical spline, a ring gear is fixed on a crankshaft, the pinion is located not yet to bring in mesh with the ring gear when an engine key switch (a starting switch) is turned OFF. The starter is designed so that when the engine key switch is turned ON, the pinion moves in an axial direction so as to be brought in mesh with the ring gear via a shift mechanism, further with an operation of a motor, rotational force of the motor is transmitted to the crankshaft via the pinion and the ring gear.

There are various modes for a mechanism for bringing them in mesh with each other between the pinion and the ring gear. For example, in a magnetic shift mode, the pinion is brought in mesh with the ring gear by utilizing attractive force of an electromagnet and by means of a torsion spring and a shift lever, a plunger is moved by means of electromagnetic attractive force so as to push out the pinion, when the pinion is not collided with the ring gear, both of them are smoothly brought in mesh with each other so as to close a contact for rotation of the motor (the starting motor) Further, when both of them are not yet brought in mesh with each other by colliding teeth of the pinion with that of the ring gear at end faces, a torsion spring is deflected so as to close the contact, an armature is rotated by carrying a current to the motor, then the pinion is rotated while being pushed to the ring gear by means of pressure of the torsion spring and thrust due to a helical spline on the rotary shaft of the motor, so that the pinion is brought in mesh with the ring gear by deviating the teeth of the pinion.

Other than that, as a mode to decrease to least possible impact force due to collision of the pinion with the ring gear, there is such a mode as that when the key switch is turned ON, the pinion is moved up to the end faces of the teeth of the ring gear via a shift mechanism, simultaneously, the motor is rotated with its fine speed by carrying a fine current to the motor via an attraction coil employed for the shift mechanism, with this rotation, the pinion is moved from a pressurizing state against the teeth of the ring gear so as to be brought in mesh with each other, and at the time of being brought in deep mesh with each other for both of them, the contact of a magnetic switch is closed so that the motor is to be rotated with full power.

Further, recently, as disclosed in Japanese Unexamined Patent Publication H9-53550, for example, such a mode is proposed as that, the ring gear is mounted on a rotary shaft (an input shaft) of a vehicular generator (an alternator) without mounting on the crankshaft, the engine switch is turned ON so as to move the pinion on a side of the ring gear via the helical spline, so that the pinion and the ring gear are brought in mesh with each other, thereafter, when the motor is rotated, its rotational force of the motor is transmitted with power to the crankshaft via a route from the pinion, the ring gear, the input shaft of the generator and a pulley, belt, and to the crankshaft.

In this conventional example, when the key switch is turned ON, the magnetic switch is turned ON so as to carry a current to the armature of the motor, thereby, the output shaft of the motor is rotated, so that the pinion and the ring gear are brought in mesh with each other by means of an advanced movement of the pinion due to the rotation of the output shaft of the motor and the thrust from the helical spline.

After completion of starting operation, the pinion is separated from the ring gear by mean of action of a return spring and the one-way clutch and action of the helical spline, when engine speed further increases, the rotation of the crankshaft is transmitted to the input shaft of the generator, and the input shaft can rotate with a sufficient revolutionary speed for a power generation operation.

As described above, in a case where the ring gear is mounted on the input shaft of the generator, since a power transmission mechanism ranging from the pinion to the crankshaft is constituted of two stage reduction gear mechanisms of the pinion and the ring gear, and of the belt and the pulleys, so that a reduction gear ratio between the ring gear and the pinion can be reduced by an amount of that degree, there is advantage for realizing a decrease in diameter of the ring gear.

In any of modes of the prior art described above, since collision force is occurred when the pinion and the ring gear are brought in mesh with each other, it is desired from the point of view for preventing the gears from wearing and damaging that the collision force is to be decreased to least possible degree.

Especially, in a recent vehicle, such a mode of operation is proposed as that other than exerting a starting operation by means of an engine key switch operation, when the vehicle becomes, for example, at its zero speed state, that is, a vehicle stoppage state due to a red light of a traffic signal or the like during driving of an internal combustion engine, a temporal fuel stoppage is carried out by means of an engine controller so as to stop the engine(Idling stop), when a driver depresses an accelerator, the engine controller determines that traveling is required and the engine is controlled for restarting. However, with the adoption this mode, the conventional starting system tends to increase in a frequency of collisions. Therefore, a reduction in above-described collision force is furthermore demanded.

SUMMARY OF THE INVENTION

An object of the present invention is, firstly, to provide a starting system of an internal combustion engine capable of remarkably improving durability and service life of the ring gear and the pinion by eliminating collision of the pinion with the ring gear caused by bringing in conventional mesh with each other between the pinion and the ring gear.

Another object of the present invention is to provide a starting system of an internal combustion engine capable of realizing a decrease in diameter of a ring gear, miniaturization of the system, and in turn, a reduction in load of an internal combustion engine.

(1) A first aspect of the invention is characterized in that in a starting system for an internal combustion engine including a pinion mounted on a rotary shaft of a starting motor and a ring gear for transmitting rotational force of the motor to a crankshaft of the internal combustion engine by bringing the ring gear in mesh with the pinion, a rotatable shaft (hereinafter, this shaft is called "an intermediate shaft") is interposed between an output shaft of the motor and the crankshaft, the ring gear is mounted on this intermediate shaft via a bearing, this ring gear is normally brought in mesh with the pinion directly or indirectly via a rotation transmission member, one clutch element for coupling and releasing of the coupling both the intermediate shaft and the ring gear is fitted by a spline to the intermediate shaft, the other clutch element is provided on the ring gear, and the one clutch element fitted by the spline is set so as to move on a side of the ring gear via a shift mechanism when a starting switch of the internal combustion engine is turned ON and so as to be separated from the ring gear when the starting switch is turned OFF, and the intermediate shaft is coupled with the crankshaft via a power transmission mechanism to constitute a reduction gear mechanism when viewed from a side of the intermediate shaft toward a side of the crankshaft.

According to a structure described above, the pinion and the ring gear are normally in a state for bringing them in mesh with each other, however, since a clutch element (hereinafter it is called "a movable clutch") fitted by the spline to the intermediate shaft is not in a joining state with a clutch element (hereinafter it is called "a stationary clutch") on the side the ring gear except at the time of starting the internal combustion engine, the ring gear is in a freely rotatable state on the intermediate shaft via the bearing.

When the starting switch of the internal combustion engine is turned ON, the movable clutch element is joined with the stationary clutch on the side of the ring gear by shifting on the intermediate shaft, further, since the movable clutch element is fitted by the spline, when the starting motor is rotated, its rotational force is transmitted to the crankshaft via the pinion, the ring gear, the clutch elements (the stationary clutch element and the movable clutch element), the intermediate shaft, the power transmission mechanism, and the crankshaft, and the internal combustion engine starts operation.

After completion of the starting operation, when the starting switch is turned OFF, the movable clutch element is separated from the ring gear, and a clutch joining is released.

When this clutch joining is released, since the ring gear is in the state to be freely rotatable on the intermediate shaft via the bearing as described above, power of the crankshaft during driving of the internal combustion engine is transmitted up to the intermediate shaft, and is not transmitted to the side of the ring gear. Accordingly, there is no trouble, even if the ring gear and the pinion on a side of the starting motor are normally in a state for bringing them in mesh with each other.

According to the present invention, since the ring gear and the pinion of the starting motor are normally in the state for bringing them in mesh with each other, there occurs no collision between the ring gear and the pinion even at the time of starting, so as to prevent both the gears (the ring gear and the pinion) from wearing and damaging. Further, since the intermediate shaft and the crankshaft are coupled with each other via a power transmission mechanism to constitute the reduction gear mechanism viewed from the side of the intermediate shaft toward the side of the crankshaft, a reduction gear ratio between the pinion and the ring gear to constitute its upper stage reduction gear mechanism is possible to be lessened, a decrease in diameter of the ring gear can be realized.

As the intermediate shaft described above, for example, accessories such as a rotary shaft of a vehicular generator (an input shaft of a generator) or a rotary shaft of a vehicular compressor is conceived, during driving after completion of the starting operation of an internal combustion engine, power from the crankshaft is transmitted to this intermediate shaft via the power transmission mechanism, power generation operation or compressor operation according to requirement is to be conducted. In this case, the power transmission mechanism constitutes a step-up gear mechanism when viewed from a side of the crankshaft toward a side of the intermediate shaft, revolutionary speed necessary for the generator and the compressor can be secured. Further, when performing the power generation operation or the compressor operation, the intermediate shaft (the input shaft of the generator or the input shaft of the compressor) is capable of rotating with little regard to the ring gear, therefore a decrease in load of the generator or the compressor can be realized.

(2) A second aspect of the invention is characterized in that in a starting system for an internal combustion engine including a pinion mounted on a rotary shaft of a starting motor and a ring gear for transmitting rotational force of the motor to a crankshaft of the internal combustion engine by being brought in mesh with the pinion, the ring gear is mounted on the crankshaft via a bearing, this ring gear is normally brought in mesh with the pinion directly or indirectly via a rotation transmission member, further, one clutch element for coupling and releasing of the coupling both the crankshaft and the ring gear with each other is fitted by a spline to the crankshaft, the other clutch element is provided on the ring gear, and the one clutch element fitted by the spline is set so as to move on a side of the ring gear via a shift mechanism when a starting switch of the internal combustion engine is turned ON and so as to be separated from the ring gear when starting switch is turned OFF.

In the present invention, an intermediate shaft which is employed in the case of the first aspect of the invention, is eliminated and the ring gear is directly mounted on the crankshaft via the bearing, a state normally for bringing them in mesh with each other between the ring gear and the pinion is maintained.

Both the pinion and the ring gear are in the state normally for bringing them in mesh with each other, except at the time of starting of the internal combustion engine, a clutch element (hereinafter, it is called "a movable clutch element") fitted by the spline to the crankshaft is not in a joining relationship with a clutch element (hereinafter, it is called "a stationary clutch element") on the side of the ring gear, therefore, the ring gear is in a state to be freely rotatable on the crankshaft via the bearing.

When the starting switch of the internal combustion engine is turned ON, the movable clutch is shifted on the intermediate shaft, so as to be joined with the stationary clutch element on the side of the ring gear, further, since the movable clutch element is fitted by the spline to the crankshaft, when the starting motor is rotated, its rotational force is transmitted to the crankshaft via the pinion, the ring gear, the clutch elements (the stationary clutch element and the movable clutch element), and the crankshaft, so that an operation of the internal combustion engine is started.

When the starting switch is turned OFF after completion of the starting operation, the movable clutch element is separated from the ring gear so as to release the clutch joining.

In the present invention, since the ring gear and the pinion of the starting motor are normally in the state for bringing them in mesh with each other, even at the time of starting, never is occurred such as a collision between the ring gear and the pinion so as to prevent both of the gears (the pinion and the ring gear) from wearing and damaging.

BRIEF DESCRIPTION OF THE DRAWINGS

Preferred embodiments of the present invention will be described in detail based on the following figures, in which.

DESCRIPTION OF THE PREFERRED EMBODIMENTS

Embodiments of the present invention will be described on the basis of an embodiment of the present invention illustrated in each of the attached drawings.

Figure 1:
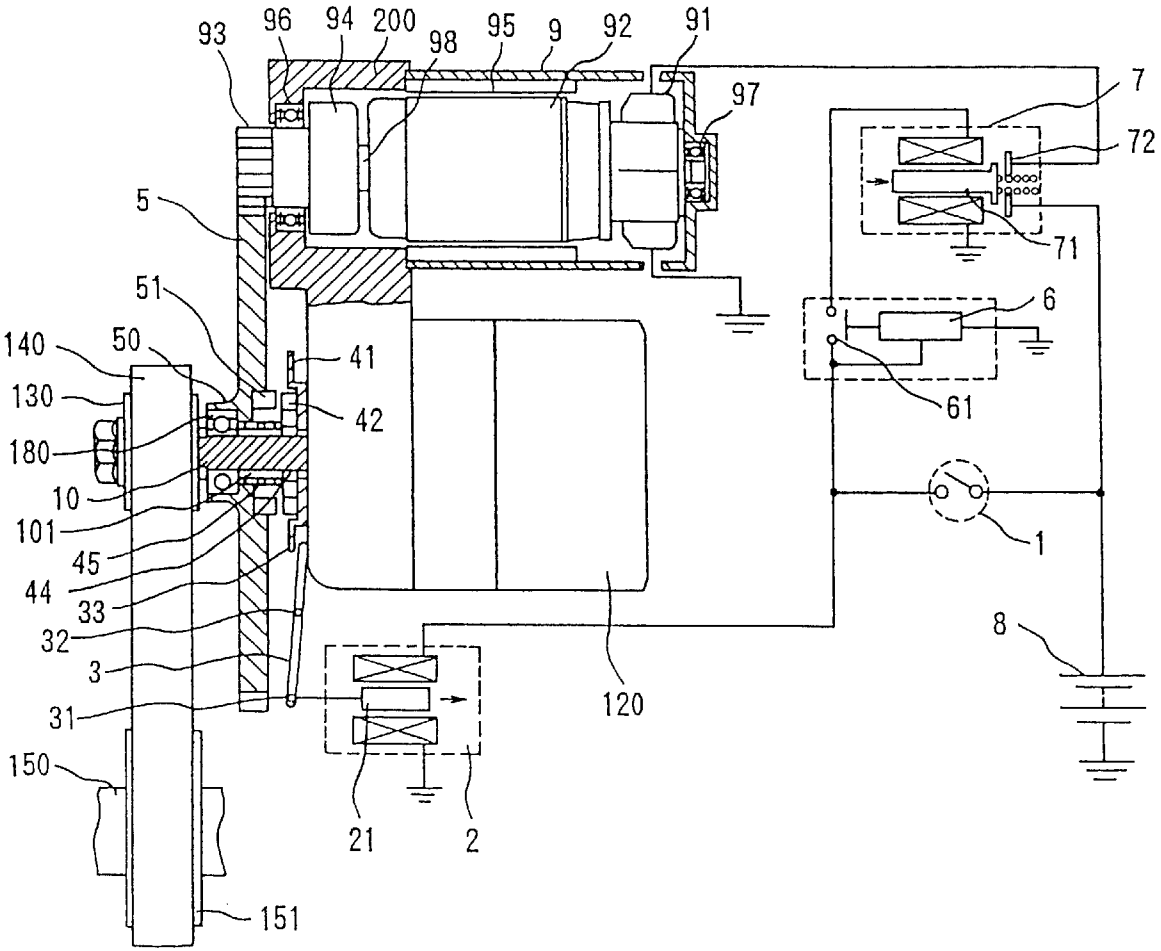
FIG. 1 is a view illustrating a structure prior to a input of starting switch of a starting system of an internal conversion engine according to a first embodiment of the present invention.
Figure 2:
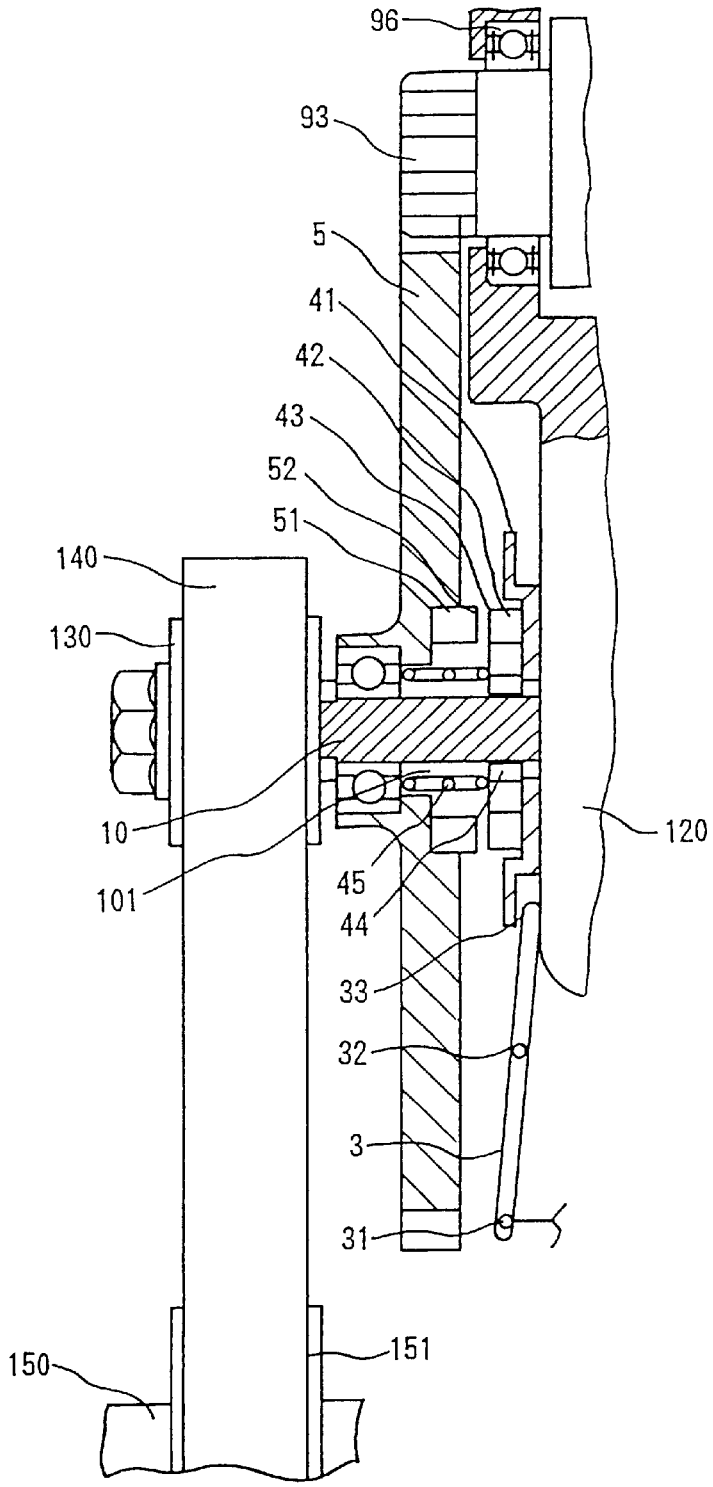
FIG. 2 is a fragmentary enlarged view according to the first embodiment.
Figure 3:
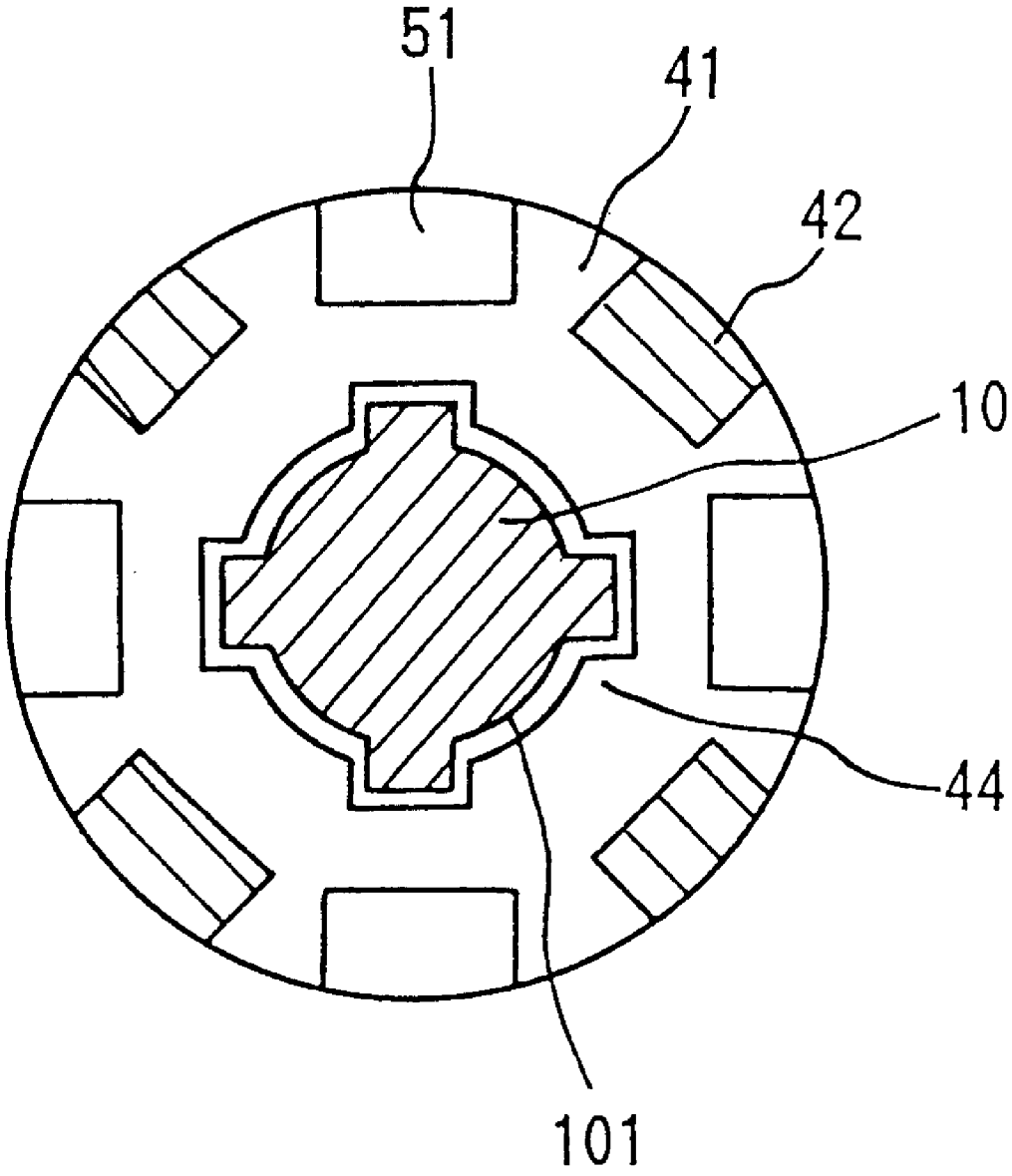
FIG. 3 is a sectional view typically illustrating an engaging state of an input shaft of a generator and a clutch element according to the first embodiment.
Figure 4:
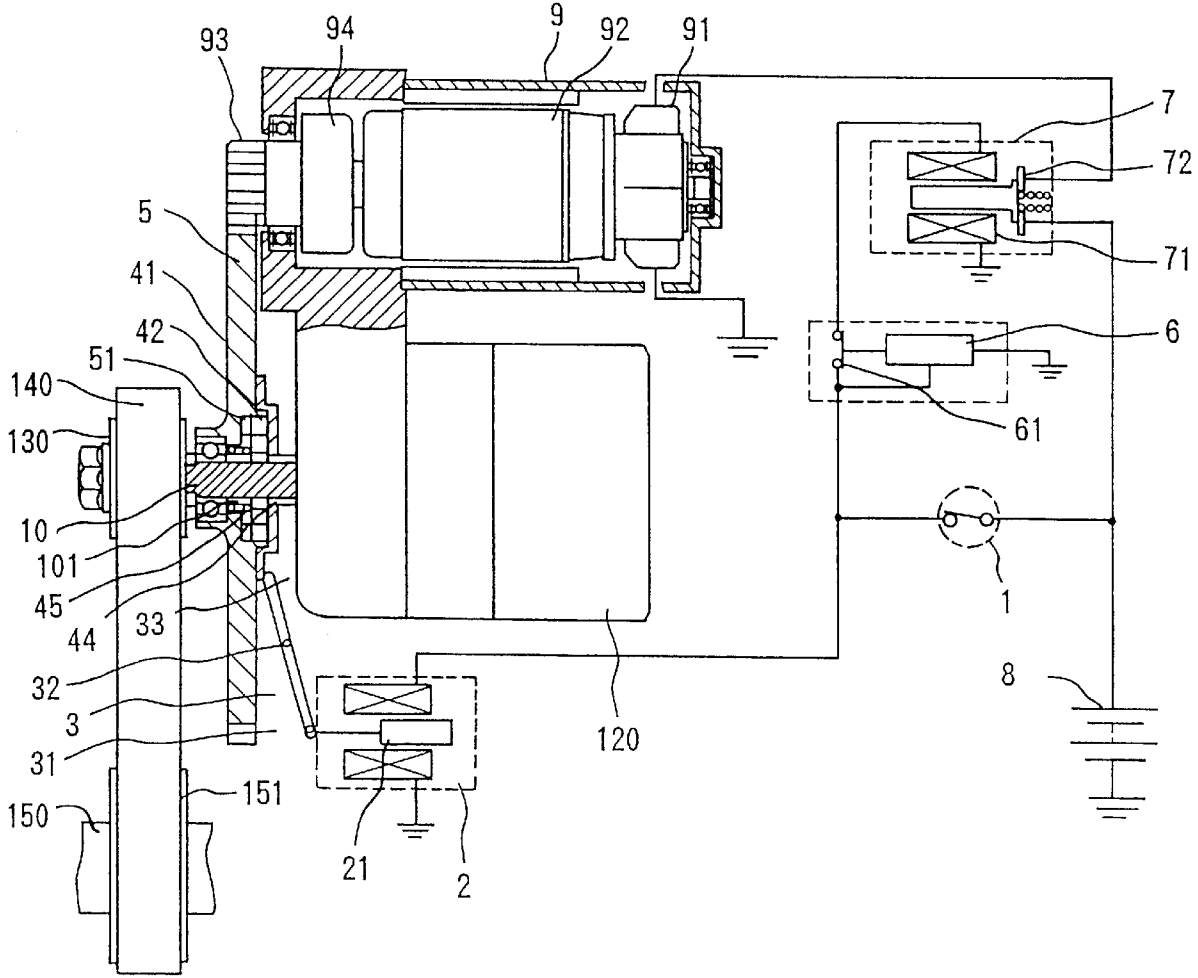
FIG. 4 is a view illustrating a structure posterior to an input of starting switch according to the first embodiment.

FIG. 1 shows a view illustrating a structure prior to an input of a starting switch of a starting system (a starter) for an internal combustion engine according to a first embodiment of the present invention, FIG. 2 shows an enlarged fragmentary view according to the embodiment, FIG. 3 shows a sectional view typically illustrating an engaging state of an input shaft of a generator and a clutch element according to the embodiment, FIG. 4 shows a view illustrating a structure posterior to an input of starting switch according to the embodiment.

In figures, 9 designates a starting motor (hereinafter it is called a motor), 120 designates a vehicular generator, and 150 designate a clank shaft.

The motor 9 and the generator 120 are arranged adjacent with each other, and a part of their housings is integrally formed with each other as designated in 200, and this integrally formed housing 200 is mounted on an engine block not illustrated in a drawing.

The motor 9 is a direct current motor and is constituted of a stator (a field pole) 95 formed out of a permanent magnet, a rotor (an armature) 92 supported by bearings 96 and 97, and a pinion 93 integrally formed with an overrunning clutch (one way clutch) 94, this pinion 93 is mounted on an output shaft 98 on a side of the motor 9 via the overrunning clutch 94, and the output shaft 98 is supported at one end thereof by the housing 200 via the overrunning clutch 94 and the bearing 96 installed on a side of the housing 200.

The pinion 93 is not supported by a shift mechanism as the prior art, but normally positioned at a fixed position in an axial direction.

A rotary shaft (an input shaft) 10 of the generator 120 serves as an intermediate shaft interposed between a rotary shaft (the output shaft) 98 on the side of the motor 9 and the crankshaft 150 and this intermediate shaft (the input shaft of the generator) 10 is mounted with a ring gear 5 via a ball bearing 180. A boss 50 for insertion and passing through the shaft is formed in a central section of the ring gear 5, and an outer ring of the ball bearing 180 is securely attached on an inner periphery of this boss, and an inner ring of the ball bearing 180 is securely attached on an outer periphery of the input shaft 10 of the generator.

As will clearly be understood from FIG. 2, a position in an axial direction of the ring gear 5 is fixed and the ring gear 5 is in a state normally for bringing it in mesh with the pinion 93. Of the ring gear 5, at the central section of a face directing toward a side of the generator 120 is formed a clutch element (a stationary clutch element) 51 having a teeth profile. Between the ring gear 5 and a front end face of the generator 120, another one side clutch element (a movable clutch element) 42 having the teeth profile integrally formed with a clutch plate 41 is fitted by a spline on the input shaft 10 of the generator. With these clutch elements 42 and 51, a claw clutch (a clutch gear) is constituted. As illustrated in FIG. 2 and FIG. 3, splines 101 and 44 are formed to be engaged with each other on the input shaft 10 of the generator and the movable clutch element 42, and the movable clutch element 42 is guided by these splines and is mounted on the input shaft of the generator 10 movable in an axial direction of the input shaft 10 of the generator.

The clutch plate 41 is coupled at one end thereof with a point of application 33 of a shift lever 3 serving as a shift mechanism of the movable clutch element (the clutch gear) 42, a point of force 31 of the shift lever 3 is connected to a plunger 21 of a solenoid 2 for attracting a lever. A numeral 32 designate a fulcrum of the shift lever 3. A return spring 45 is interposed between the movable clutch element 42 and the bearing 180 of the ring gear 5, and the movable clutch element 42 is energized in a direction apart from the stationary clutch element 51 by means of spring force of this return spring 45.

A pulley 130 is fixed at the tip end of the input shaft 10 of the generator, a belt 140 is wound around this pulley 130 and a pulley 151 provided on a crankshaft 150 of the internal combustion engine, and a power transmission mechanism is constituted of the input shaft 10 of the generator and the crankshaft 150.

Since a diameter of the pulley 130 is made smaller than a diameter of the pulley 151, this power transmission mechanism is designed so as to constitute a reduction gear mechanism when viewed from a side of the input shaft (the intermediate shaft) 10 of the generator toward a side of the crankshaft 150, on the contrary, is designed so as to constitute a step-up gear mechanism when viewed from the side of the crankshaft 150 toward the side of the input shaft 10 of the generator.

A numeral 1 designates a key switch (a starting switch) of the engine, 6 designates a timer relay, 7 designates a solenoid for carrying a current to the motor to be operate by turning ON the timer relay 6, and 8 designates a battery.

Incidentally, an operation of the present embodiment will be described.

As illustrated in FIG. 1, except at the time of a starting operation of the internal combustion engine, the movable clutch element 42 on the input shaft 10 of the generator is designed to reside in an initial position separated from the stationary clutch element 51 on the side of the ring gear 5 while being pushed by force of the return spring 45.

In order to start an engine, when the key switch 1 is turned ON, first, a current is carried to the solenoid 2 for attracting the lever, the plunger 21 is moved in an attracting direction (an arrow mark direction), simultaneously, the point of force 31 of the shift lever 31 is attracted. The shift lever 3 is turned around the fulcrum 32 and by means of the point of application 33, the clutch plate 41 and the movable clutch element (the clutch gear) 42 are moved toward the side of the ring gear 5. With this structure, the movable clutch element 42 will stand still by being brought into contact with an end face of the stationary clutch element 51 of the ring gear 5 or by being brought in mesh with the stationary clutch element 51 as it is.

Further, simultaneous with turning ON of the key switch 1, a current is carried to the timer relay 6, the solenoid 2 is attracted by the timer operation of the timer relay 6, that is, after passing through a necessary and sufficient time for the movable clutch 42 is brought into contact with the end face 52 of the stationary clutch element 51 of the ring gear 5 by means of the shift lever 3 or the time for the movable clutch element 42 is brought in mesh with the stationary clutch element 51, a timer relay contact 61 is closed.

Thereby, a current is carried to a solenoid 7 for carrying the current to the motor, a plunger 71 is attracted so as to close a main contact 72 for carrying the current to the motor. By closing the contact 72, the battery 8 is connected to the motor 9, the current is carried to the motor 9 via a brush 91, the armature 92 is rotated, and the pinion 93 is rotated. By the rotation of the pinion 93 normally for bringing it in mesh with the ring gear 5, the ring gear 5 rotates, at this time, in a case where the gear end faces 52 and 43 of the stationary clutch element 51 and the movable clutch element 42 are brought into contact (not yet to bring them in mesh with each other), when the movable clutch element 42 arrives to a position for bringing it in mesh with the stationary clutch element 51, by means of the rotation of the ring gear 5, teeth of the movable clutch element 42 is brought in mesh with teeth of the stationary clutch element 51 by means of pressurization of the shift lever 3.

Thereby, rotating force of the motor 9 is transmitted to the crankshaft 150 via the pinion 93, the ring gear 5, a stationary clutch element 51, the movable clutch element 42 fitted by the spline, the input shaft 10 of the generator, the pulley 130, the belt 140 and the pulley 151, thus the engine is started its operation.

After completing the starting operation of the engine, when the key switch 1 is turned OFF, the solenoid 2 for attracting the lever is turned OFF, pressurizing force against the movable clutch element 42 of the shift lever 3 is released, the movable clutch element is pushed back at the initial position by means of the force of the return spring 45, thereby the clutch is cut off. In this state, since the ring gear 5 is left in a freely rotatable (free) manner on the input shaft of the generator via the bearing 180, transmission of rotational force from the side of the crankshaft after starting operation of the engine is limited to be transmitted to the input shaft 10 of the generator via a power transmission mechanism constituted of the pulley 151, the belt 140, and the pulley 130, and not transmitted from the ring gear 5 to the pinion 93, in turn, to a side of the motor 9.

Further, simultaneous with turning OFF of the solenoid 2 for attracting the lever, the timer relay 6 is turned OFF, the solenoid 7 for carrying the current to the motor is turned OFF, the contact 72 is opened so as to eliminate carrying the current to the motor 9, hence stops rotation of the motor. After this starting operation of the engine, the crankshaft 150 rotates, the input shaft of the generator 120 is rotated via the belt 140 so as to be carried out power generation. At the time of this power generation, the power transmission mechanism constituted of the pulley 151, the belt 140, and the pulley 130 constitutes the step-up gear mechanism contrary to time for the starting operation.

A gear ratio between the pinion 93 and the ring gear 5 and a ratio between diameters of the pulley 130 and the pulley 151 are set to a necessary and sufficient value for the starting operation of the engine and the power generation. In the motor 9, during the time while the clutch elements 42 and 51 are in a joining state, in order not to transmit the rotational force to the armature 92, when the pinion 93 is received rotation of the ring gear 5 from the crankshaft 150 via the input shaft of the generator 10, the motor 9 has such a structure as that an overrunning clutch 94 is interposed between the pinion 93 and the armature 92, thereby the armature 92 is prevented from breakage due to its high speed rotation.

According to the present embodiment, since the ring gear 5 and the pinion 93 of the motor are normally in a state for bringing them in mesh with each other, there never happens such as collision between the ring gear 5 and the pinion 93 even at the time of the starting operation of the engine, thereby capable of preventing both gears from wearing and damaging or the like. As for the clutch element 42, since the element 42 is small in size and light in weight comparing with the pinion, and its amount of shifting can be reduced compared with the conventional pinion, so that both clutch elements are guaranteed to be positively brought in mesh with each other under least impact force by lessening an inertia of the clutch elements at the time of collision.

Further, since the input shaft 10 of the generator serving as the intermediate shaft and the crankshaft 150 are coupled with each other via the power transmission mechanism (130, 140, 151) to constitute reduction gear mechanism when viewed from the side of the input shaft 10 of the generator toward the side of the crankshaft 150, thereby, a decrease in a reduction gear ratio between the pinion 93 and the ring gear 5 which serve as an upper stage reduction gear mechanism is possible to be realized, so that a reduction in diameter of the ring gear 5 can be realized.

Further, during operation of the power generation, since the input shaft 10 of the generator can be rotated with little regard to the ring gear 5, a decrease in load of the generator can be realized.

Figure 5:
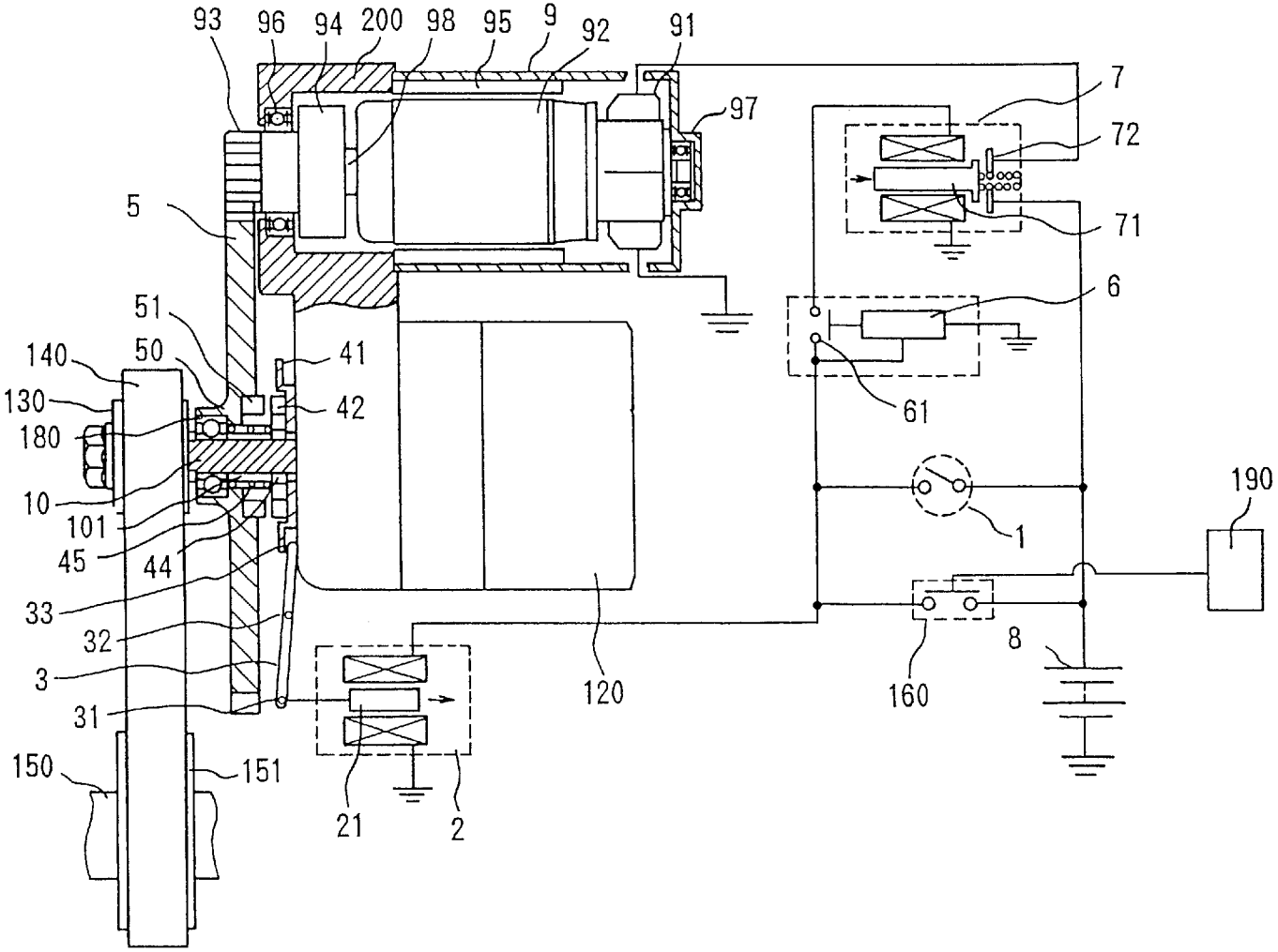
FIG. 5 is a view illustrating structure according to a second embodiment of the present invention.

FIG. 5 shows a view illustrating a structure according to a second embodiment of the present invention, a fundamental structure of the starter is similar as the first embodiment, the second embodiment differs from the first embodiment in a point that a control switch 160 in respect to an idling stop is additively connected to an electric circuit for starting operation of the internal combustion engine in parallel with the key switch 1. The control switch 160 is one of the starting switch similar as the key switch 1.

The control switch 160 is controlled to ON/OFF by means of a command signal from an engine controller 190, thereby a stop/restart of the internal combustion engine is possible to be conducted in a same manner as a case of the key switch.

The control switch 160 is in a state of turn OFF except in a case of the starting operation of the engine by means of this switch.

In a case where an engine is in an idling state with vehicle speed 0, that is, at a stoppage of a vehicle, the controller 190 detects this fact and issues an engine stoppage signal, and based on that the engine is stopped by cutting off fuel. Thereafter, when a driver depresses an accelerator, the controller 190 detects this depression and determines that traveling is required, the control switch 160 is made to turn ON based on the command signal. Thereby, an engine is capable of restarting by means of the operation similar as a case where the engine key switch is turned ON as described above.

In the case of introduction of such an idling stop control, a frequency of the starting operations is increased as compared with a case of starting an engine by only the engine key switch, however, according to the present embodiment, the pinion is normally in a state for bringing it in mesh with the ring gear, therefore, durability of the pinion and the ring gear is possible to be improved.

Figure 6:
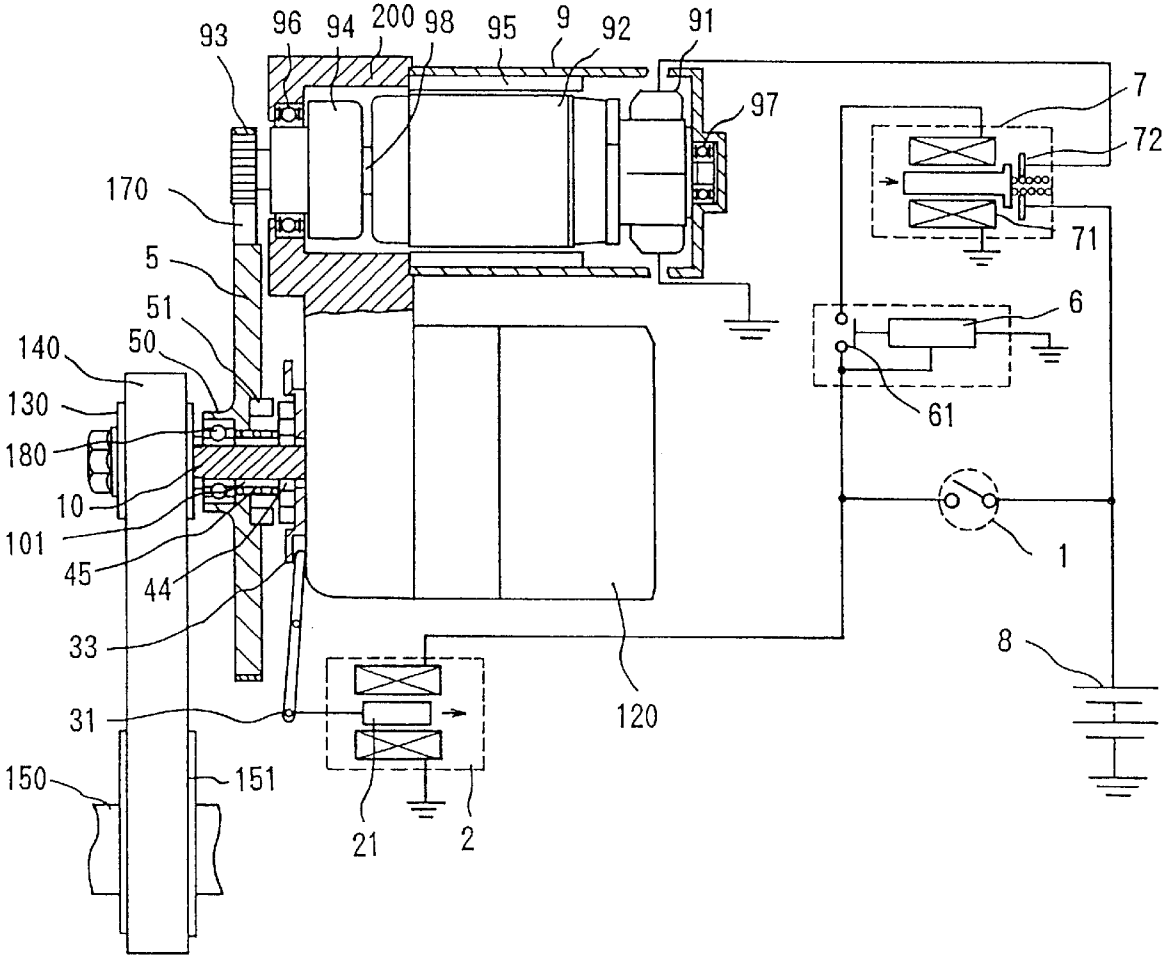
FIG. 6 is a view illustrating a structure according to a third embodiment of the present invention.
Figure 7:
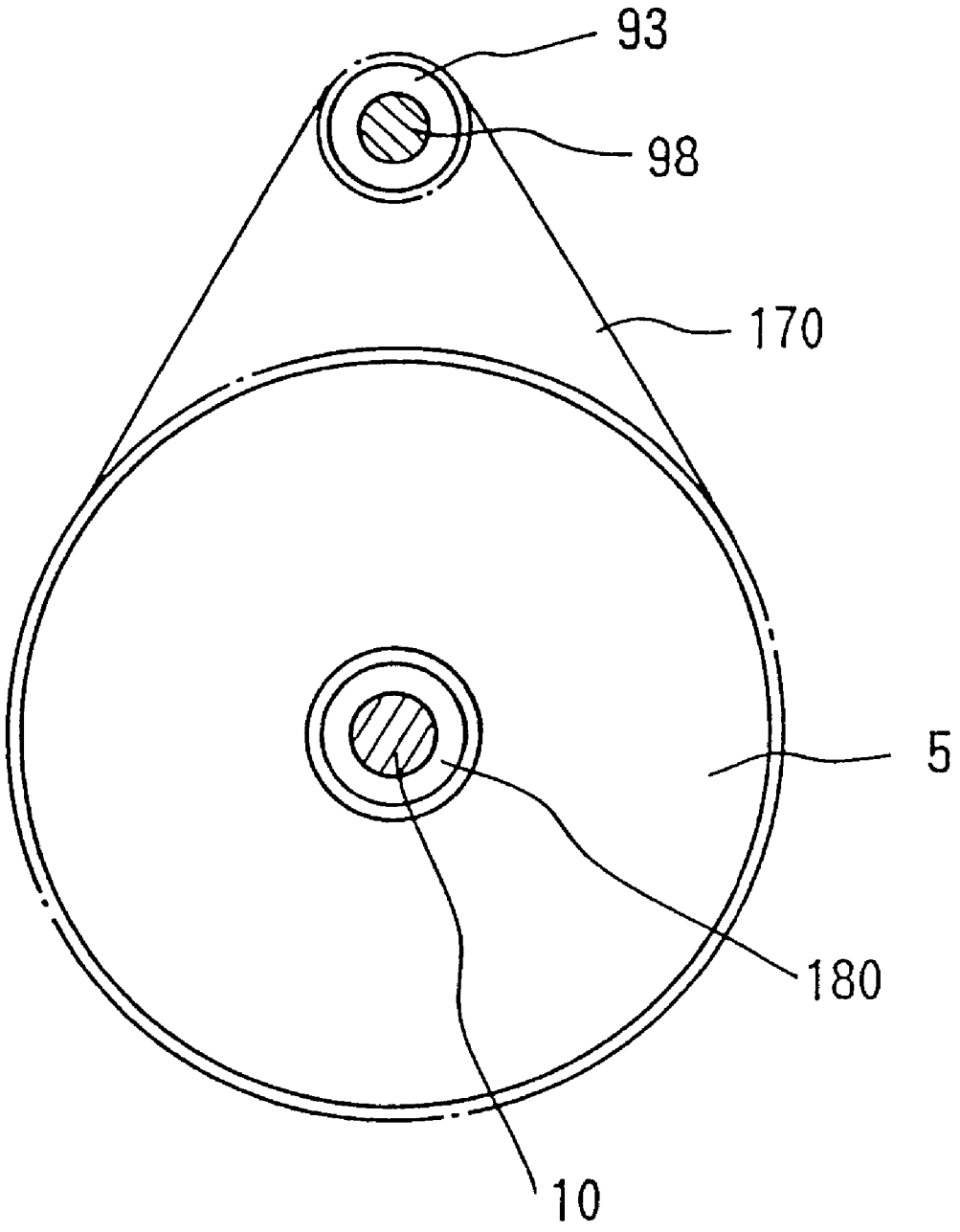
FIG. 7 is a view typically illustrating an arrangement of a pinion and a ring gear utilized in the third embodiment viewed from a front side.

FIG. 6 shows a view illustrating structure according to a third embodiment of the present invention, FIG. 7 shows a view illustrating an arrangement of the pinion 93 and the ring gear 5 as a part of the third embodiment viewed from the front side, the third embodiment differs from the first and the second embodiments in a point that the pinion 93 is not directly brought in mesh with the ring gear 5, but indirectly is brought in mesh via a chain 170.

Even in the present embodiment, it is natural that a similar effect is obtained as the embodiments described above, however, in addition to that, a low-noised chain made of synthetic rubber or the like is used as the chain 170, low noising at the time of starting operation of the engine can be realized.

Figure 8:
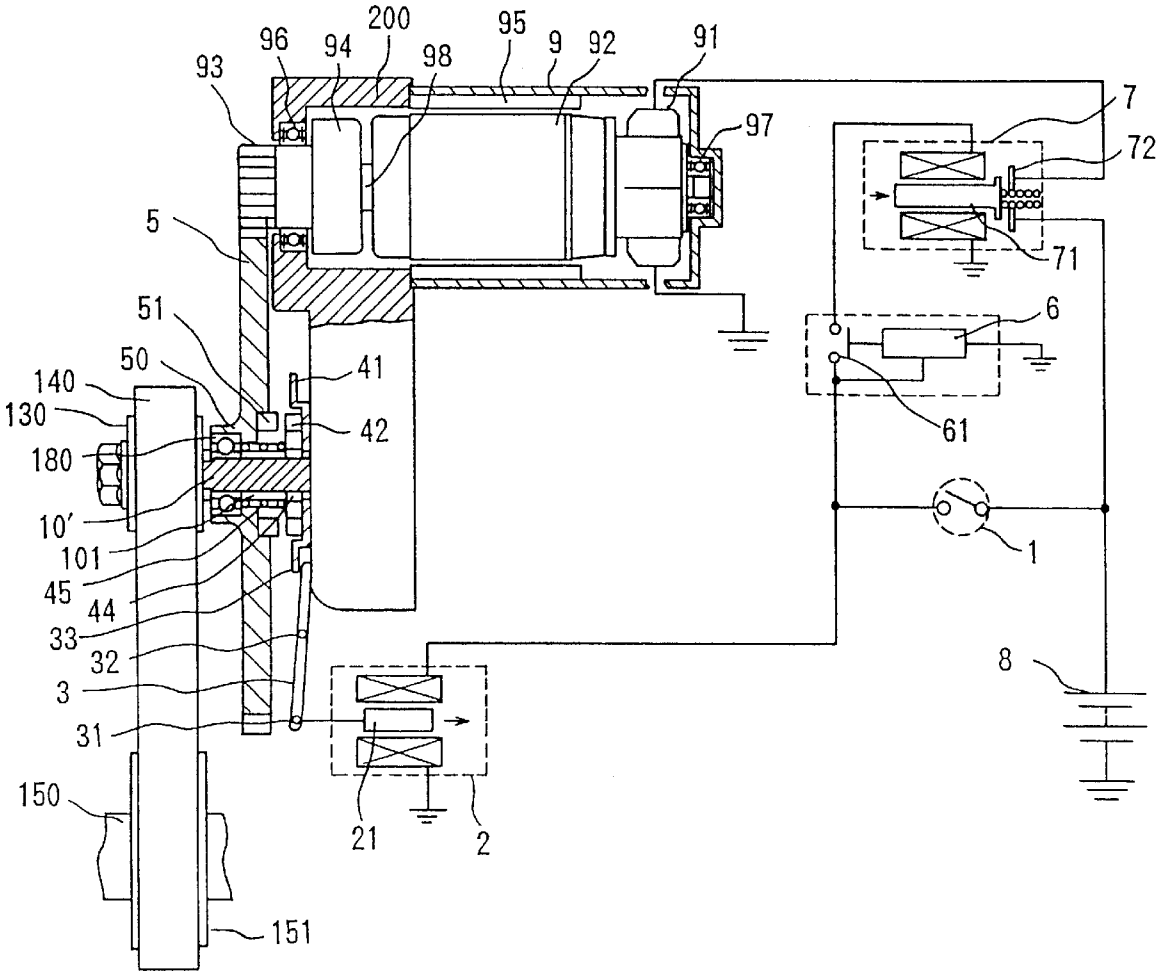
FIG. 8 is a view illustrating a structure according to a forth embodiment of the present invention.

FIG. 8 shows a view illustrating a structure according to a fourth embodiment of the present invention, the fundamental structure of the starter is similar as the first and the second embodiments, the fourth embodiment differs from the first and the second embodiments in a point that as the intermediate shaft for mounting with the ring gear 5 a dedicated intermediate shaft 10' is utilized without employing the input shaft 10 of the generator. Even with such a structure, similar effects as the embodiments described above is possible to be produced.

Figure 9:
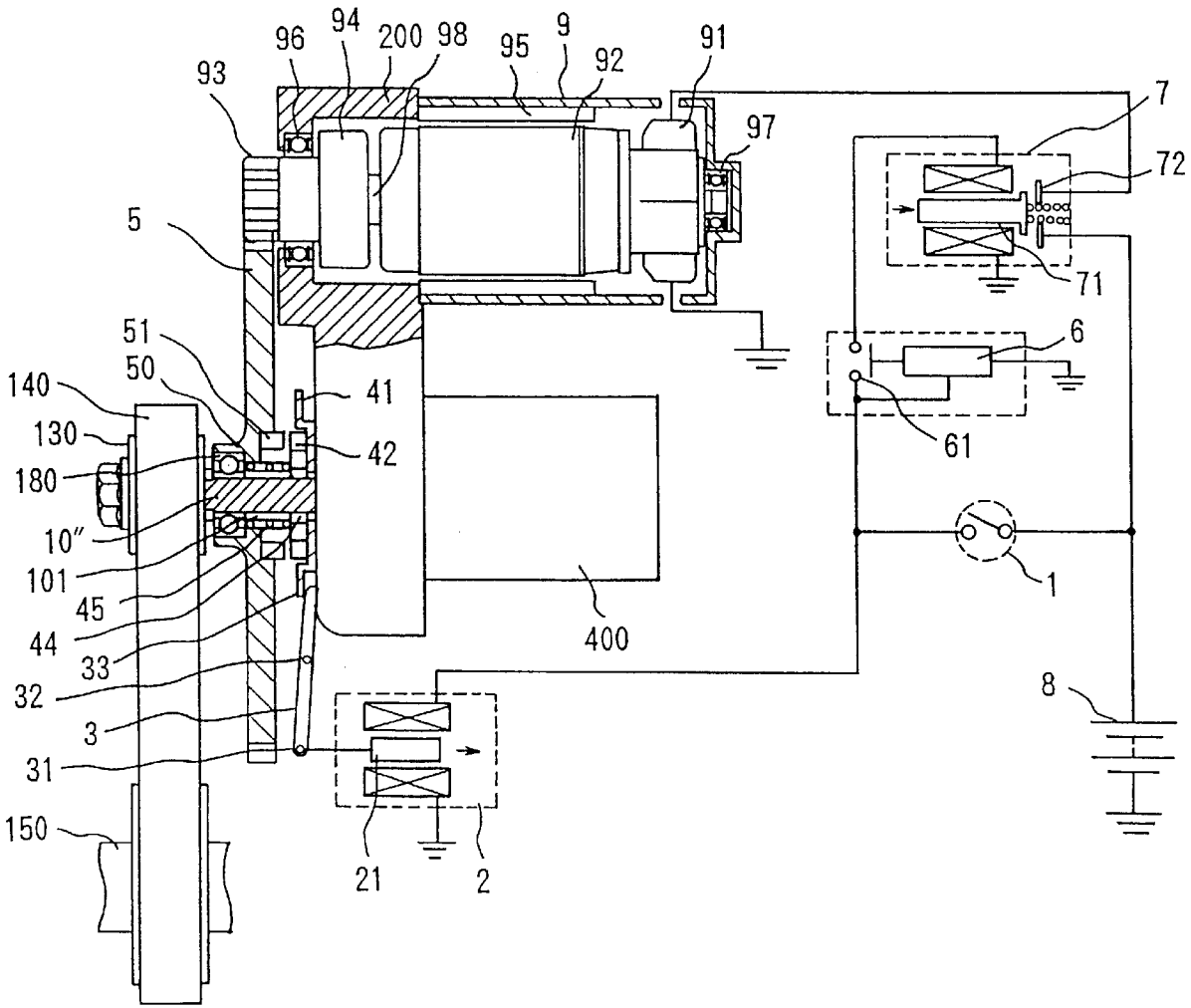
FIG. 9 is a view illustrating a structure according to a fifth embodiment of the present invention.

FIG. 9 shows a view illustrating a structure according to a fifth embodiment of the present invention, the fifth embodiment differs from the first and the second embodiments in a point that as the intermediate shaft for mounting with the ring gear 5, in place of the input shaft 10 of the generator 120, an output shaft 10" of a compressor 400 for a vehicular air conditioning is utilized.

Figure 10:
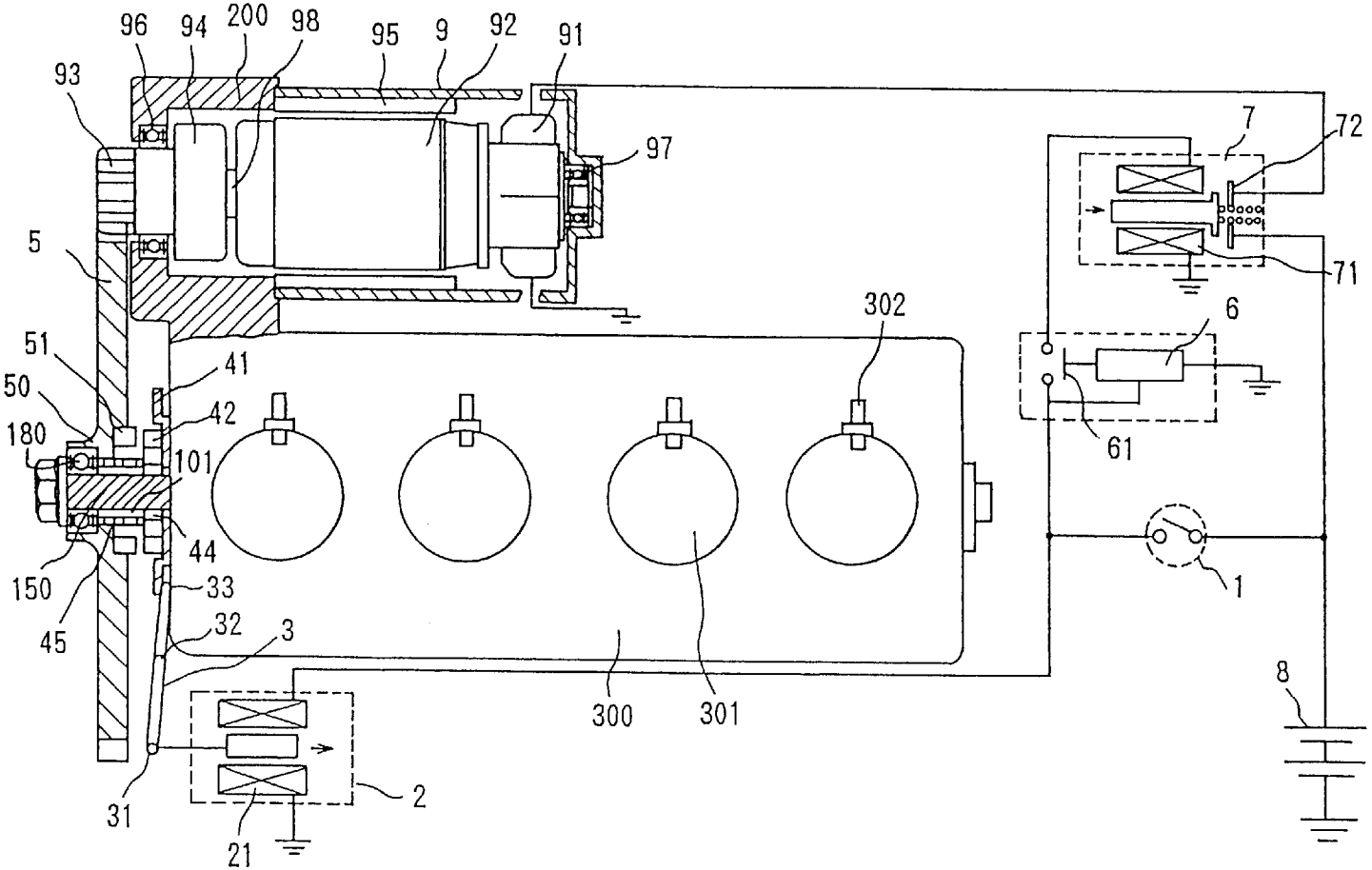
FIG. 10 is a view illustrating a structure according to a sixth embodiment of the present invention.

In the meantime, in the embodiments described above, example, wherein the ring gear 5 is provided on the intermediate shaft 10 (10' and 10") are described, however, in place of them, the ring gear 5 may well be mounted on the crankshaft 150 directory via the bearing 180, and the FIG. 10 shows a view illustrating that embodiment.

In FIG. 10, 300 designates the engine block, 301 designates a cylinder, and 302 designate an ignition plug which are typically illustrated.

The ring gear 5 is mounted on the crankshaft 150 of the internal combustion engine via the bearing 180, this ring gear 5 is normally brought in mesh directly with the pinion 93 similar as the respective embodiments described above, or indirectly via a rotary transmission member (for example, the chain 170 as shown in FIG. 6). The movable clutch element 42 together with the clutch plate 41 are fitted by the spline on the crankshaft 150. When the starting switch (the key switch) 1 is turned ON, the movable clutch element 42 moves to the side of the ring gear 5 via a shift mechanism (the shift lever) 3 similar as the embodiments described above, finally, the movable clutch element 42 and the stationary clutch element 51 are, as described above, brought in mesh with each other. Since the detail for bringing these clutch elements in mesh with each other is similar as described in the first embodiment, therefore the description of it will be omitted. In this state of bringing in mesh, the motor 9 rotates, the rotational force of the motor is transmitted to the crankshaft 150 via the pinion 93, the ring gear 5, and the clutch elements (the stationary clutch element 51 and the movable clutch element 42), then the internal combustion engine starts the operation.

After completion of the starting operation of the engine, when the key switch is turned OFF, the movable clutch element 42 is separated from the ring gear 5, and clutch joining is released.

In this invention, since the ring gear 5 is normally in the state for bringing it in mesh with the pinion 93 of the motor, even at the time of the starting operation of the engine, there exists no trouble such as collision of the ring gear with the pinion, therefore, wear and damage for both the gears can be prevented from occurring. In the meantime, as for the clutch elements 42 and 51, a friction clutch is possible to be applied other than the crow clutch.

According to a first and a second aspect of the present invention as described above, troubles such as collision of a pinion with a ring gear caused by bringing them in mesh with each other as is the case in the prior art can be eliminated, durability and the service life of the ring gear and the pinion can be remarkably improved.

Further, according to a first aspect of the invention, a decrease in diameter of the ring gear, miniaturization of a system, and, in turn, a decrease in load for an internal combustion engine can be realized.

Especially, after a starting operation of the internal combustion engine, since the ring gear does not rotate by releasing clutch joining, so that a reduction in rotary load is possible to be realized.

What is claimed is:

1. A starting system for an internal combustion engine comprising, a pinion mounted on a rotary shaft of a starting motor and a ring gear for transmitting rotational force of said motor to a crankshaft of the internal combustion engine by bringing said ring gear in mesh with said pinion, a rotatable shaft (hereinafter, this shaft is called "an intermediate shaft") is interposed between an output shaft of said motor and said crankshaft, said ring gear is mounted on this intermediate shaft via a bearing, this ring gear is normally brought in mesh with said pinion directly or indirectly via a rotation transmission member, one clutch element for coupling and releasing of the coupling said intermediate shaft and said ring gear is fitted by a spline to said intermediate shaft, other clutch element is provided on said ring gear, and the one clutch element fitted by the spline is set so as to move on a side of said ring gear via a shift mechanism when a starting switch of said internal combustion engine is turned ON and so as to be separated from said ring gear when the starting switch is turned OFF, and said intermediate shaft is coupled with said crankshaft via a power transmission mechanism to constitute a reduction gear mechanism when viewed from a side of the intermediate shaft toward a side of the crankshaft.

2. A starting system for an internal combustion engine according to claim 1, wherein said intermediate shaft is a rotary shaft of a generator to be driven by means of power of an internal combustion engine or a rotary shaft of a compressor.

3. A starting system for an internal combustion engine according to claim 1, wherein said power transmission mechanism for coupling said intermediate shaft with said crankshaft is a belt mechanism with the use of pulleys and a belt.

4. A starting system for an internal combustion engine comprising, a pinion mounted on a rotary shaft of a starting motor and a ring gear for transmitting rotational force of said motor to a crankshaft of the internal combustion engine by bringing said ring gear in mesh with said pinion, said ring gear is mounted on said crankshaft via a bearing, this ring gear is normally brought in mesh with said pinion directly or indirectly via a rotation transmission member, further, one clutch element for coupling and releasing of the coupling said crankshaft and said ring gear with each other is fitted by a spline to said crankshaft, other clutch element is provided on said ring gear, and the one clutch element fitted by the spline is set so as to move on a side of said ring gear via a shift mechanism when a starting switch of said internal combustion engine is turned ON and so as to be separated from said ring gear when the starting switch is turned OFF.

5. A starting system for an internal combustion engine according to claim 1, wherein said system is set so that when the starting switch of the internal combustion engine is turned ON, at first, said shift mechanism is operated be means of magnetic force, said one clutch element fitted by the spline is moved on the side of said ring gear, thereafter, a timer relay is operated so as to close ta main contact of the motor for rotation of said motor.

6. A starting system for an internal combustion engine according to claim 1, wherein said starting switch is constituted of a key switch for the engine and a control switch controlled to on/off by means of a command from a controller, and said key switch and said control switch are connected in parallel to an electric circuit for starting the internal combustion engine.

7. A starting system for an internal combustion engine according to claim 1, wherein said pinion and said ring gear are indirectly brought in mesh with each other via a low noise chain made of synthetic rubber.

* * * * *